United States Patent [19]

Anderson et al.

[11] Patent Number: 4,787,519

[45] Date of Patent: Nov. 29, 1988

[54] ADJUSTABLE SLIVER REMOVER

[75] Inventors: Ronel W. Anderson, Reno, Nev.; Elmer W. Stratton, Beckwourth, Calif.

[73] Assignee: Magnuson Corporation, Reno, Nev.

[21] Appl. No.: 124,057

[22] Filed: Nov. 23, 1987

Related U.S. Application Data

[63] Continuation of Ser. No. 762,685, Aug. 5, 1985, abandoned.

[51] Int. Cl.[4] ..... B07C 5/06

[52] U.S. Cl. ..... 209/674; 198/773; 209/394

[58] Field of Search ..... 209/542, 625, 659, 660, 209/674–676, 393–396, 916; 130/26; 198/773

[56] References Cited

U.S. PATENT DOCUMENTS

| | | | |
|---|---|---|---|
| 692,682 | 2/1902 | Lippy | 209/394 |
| 1,956,507 | 4/1934 | Johnson | 209/394 |
| 2,058,381 | 10/1936 | Lindgren | 209/394 |
| 2,792,929 | 5/1957 | Magnuson et al. | 198/773 |
| 3,151,729 | 10/1964 | Gardiner | 198/773 X |
| 3,204,605 | 9/1965 | Vroman | 209/676 |
| 3,269,535 | 8/1966 | Daugherty | 209/674 X |
| 3,273,711 | 9/1966 | Smith | 209/674 X |
| 3,543,928 | 12/1970 | Green | 209/674 X |
| 3,587,850 | 6/1971 | Dick | 209/674 |
| 3,921,809 | 11/1975 | Smith | 209/675 X |
| 3,944,077 | 3/1976 | Green | 209/674 X |
| 4,502,493 | 3/1985 | Jones et al. | 209/394 X |

FOREIGN PATENT DOCUMENTS

| | | | |
|---|---|---|---|
| 0213017 | 11/1908 | Fed. Rep. of Germany | 209/675 |
| 0435225 | 9/1935 | United Kingdom | 209/674 |

*Primary Examiner*—Robert B. Reeves
*Assistant Examiner*—Edward M. Wacyra
*Attorney, Agent, or Firm*—Gerald L. Moore

[57] ABSTRACT

A shuffle feed apparatus for removing slivers and comprising first and second shuffle feed members (26, 27) supported respectively between frame members (31, 32) for oscillatory motion to advance articles in rows. To adjust the size of slivers that are removed from the article mainstream, the feed members (26) are adjustable in thickness to allow the spacing between adjacent feed members to be varied. Each feed member (26) comprises a pivotally connected outer shell member (45) and inner shell member (46). The inner shell members are connected by a rail (50) attached to a lever (55) for adjusting the relative positions of the inner and outer shell members to vary the thickness of the feed members (26).

3 Claims, 5 Drawing Sheets

ADJUSTABLE SLIVER REMOVER

This is a continuation of application Ser. No. 762,685, filed Aug. 5, 1985, now abandoned.

FIELD OF THE INVENTION

A shuffle feed apparatus and sliver remover wherein the spacing between all the adjacent flights can be adjusted in unison to change the size of small articles or slivers removed from the articles being advanced.

BACKGROUND OF THE INVENTION

Shuffle feed apparatus are utilized for advancing articles such as vegetables, in rows. After the articles have been aligned as they are advanced, the sizing operation begins. The same apparatus is utilized to remove slivers or undersized pieces from the advancing stream of articles. For this purpose adjacent flights are spaced apart to form a sizing opening allowing the passage between flights of those smaller articles it is desired to separate from the main stream.

One example of such an apparatus is shown in U.S. Pat. No. 3,944,077, Shuffle Feed Sizing Mechanism, issued on Mar. 16, 1976 with Chester Green as inventor. This patent shows a shuffle feed apparatus with the flights being spaced apart to allow small articles such as slivers to be passed between flights and thus be separated from the mainstream of articles being advanced in single file order along the faces of the flights. This patent points out the need to adjust the width of the opening between flights for regulating the size of small articles separated from the mainstream. As shown in this patent, it is known to adjust the spacing between flights by adjusting the thickness of alternate flights. However, this adjustment is laborious because for each flight it is necessary to manually loosen bolts, shift the interlocking members forming the flight face and thereafter tighten the bolts to make the machine operable again. The task is even greater when trial and error must be exercised to determine what size of opening works best for removing the desired size of articles from the mainstream.

In U.S. Pat. No. 3,273,711, Shuffle Feed Sorter with Sliver Ejection, issued on Sept. 20, 1966 with Traver J. Smith as inventor, a mechanism is provided for adjusting the spacing between flights of a shuffle feed mechanism. As illustrated in that patent, the adjustment is effected by changing the relative position between the sets of flights, but in widening the spacing between one pair of flights the spacing between the next adjacent pair is narrowed. Thus, while the adjustment can be made during operation, it is only partially successful in that the size of articles ejected is made larger between every other flight pair. It is the purpose of the present invention to provide a shuffle feed apparatus in which the spacing can be easily and effectively adjusted to change the size of slivers or small articles separated from the mainstream of articles being advanced.

SUMMARY OF THE INVENTION

A shuffle feed mechanism comprising a frame, a first set of transversely disposed inclined shuffle feed members carried by said frame, a second set of transversely disposed inclined shuffle feed members carried by a second frame and interposed between the shuffle members of the first set in alternating relation therewith, means for effecting relative reciprocation between the respective sets of shuffle members to advance articles from member to member along the faces thereof in single file order, said adjacent shuffle members being spaced apart to allow the passage therebetween of small articles or slivers thereby to separate said slivers from the mainstream of the articles being advanced along the shuffle member faces, one set of shuffle members being formed of interfitting parts each having a face lying parallel to and closely adjacent the other and being supported on a lateral support and pivotally attached together, and a member connecting one set of said interlocking parts with means to actuate said connecting member to move one set relative to the other thereby to change the thickness of the flight and change the spacing between adjacent flight members.

DESCRIPTION OF THE INVENTION

Figure 1:
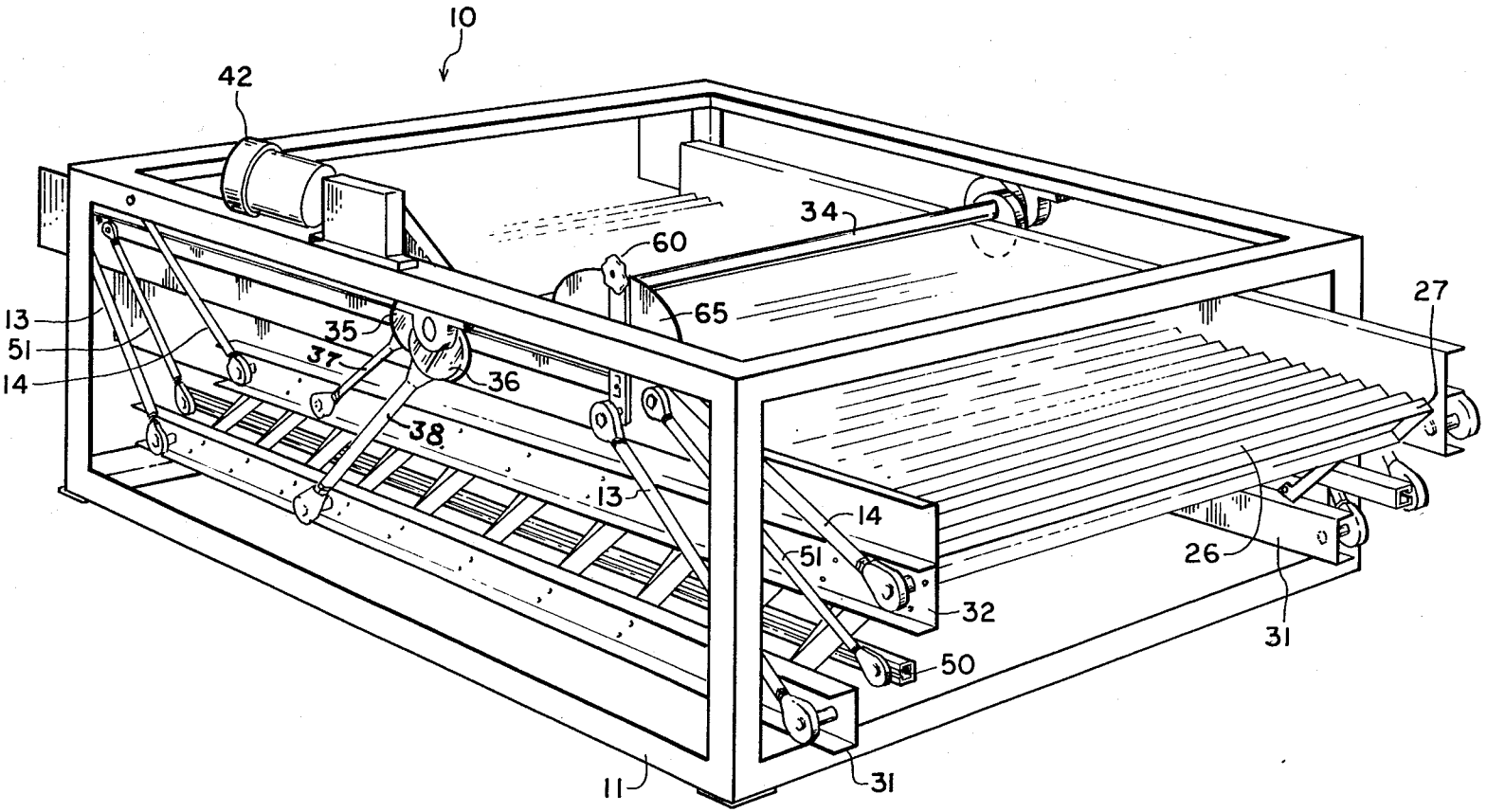
FIG. 1 is a perspective view of a shuffle feeder employing the subject invention.
Figure 2:
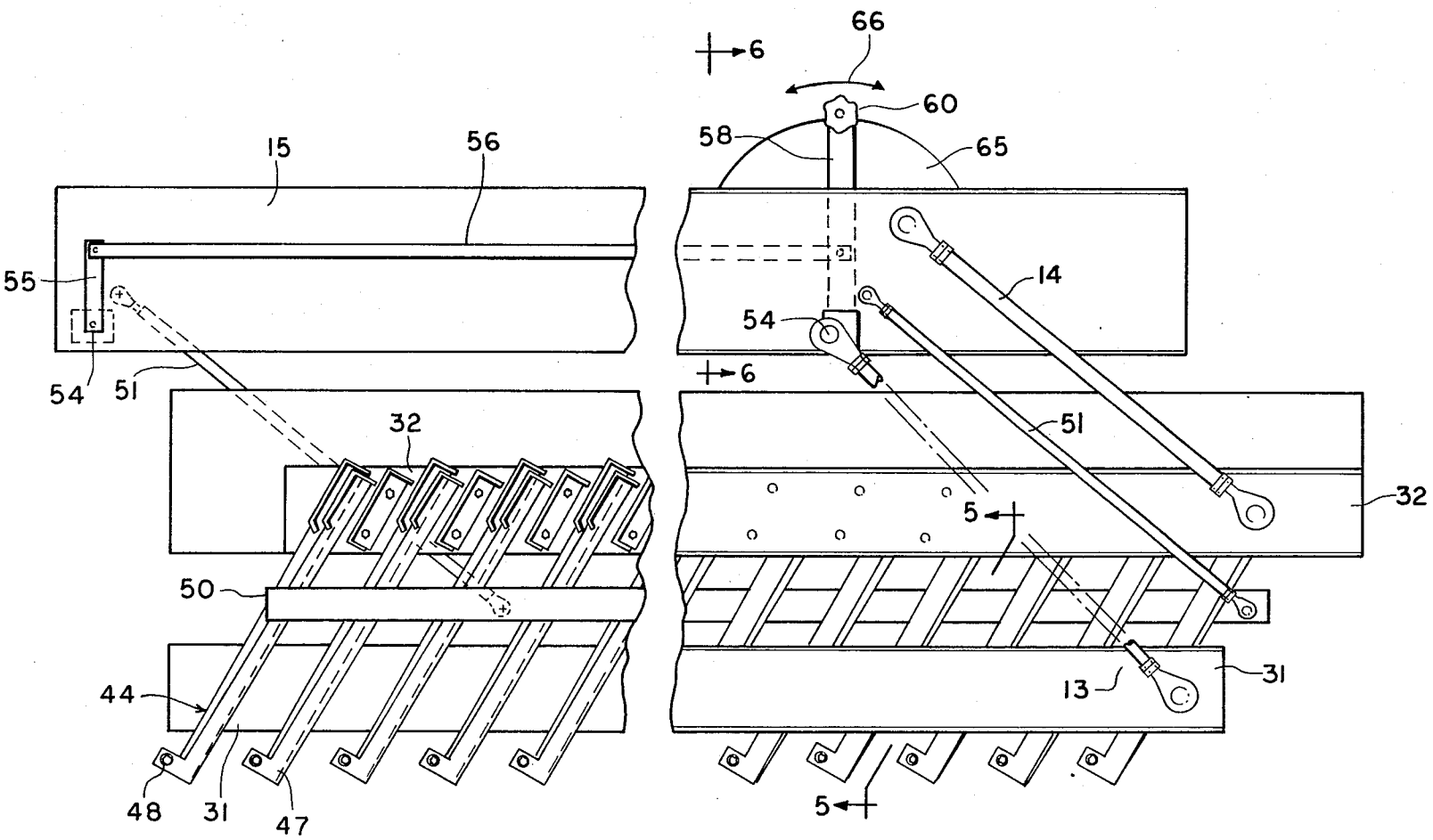
FIG. 2 is a side view, partially in cross section, of the apparatus shown in FIG. 1.
Figure 3:
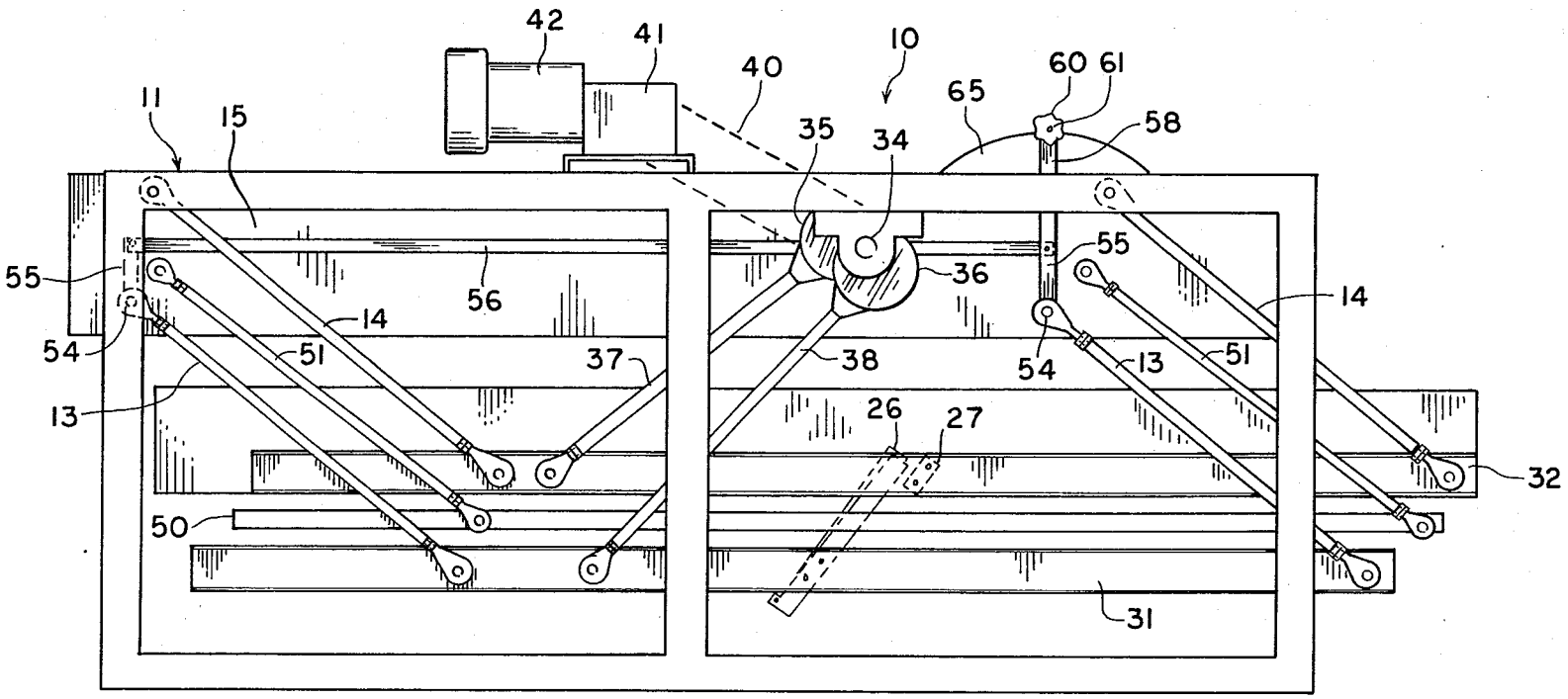
FIG. 3 is a side view of the shuffle feeder of FIG. 1.

Referring primarily to FIGS. 1, 2, and 3, there is illustrated a shuffle feed structure 10 including a supporting framework 11 comprising a box-like frame in which the shuffle feed sorting structure is supported. The sorting structure hangs on four sets or pairs of parallel links 13 and 14 suspended from a pair of channel members 15 positioned on opposite sides of the frame. Only one channel member and the connecting links are seen in the drawings. Suitable cross members connect the channel members 15.

The shuffle feed sorting structure 10 generally comprises similar sets of independently supported and alternately arranged shuffle members 26 and 27 (FIG. 3) which are fabricated from sheet metal and are mounted in an inclined position. These shuffle feed members each have long upwardly facing article supporting faces 28 and 29 which are generally disposed at right angles to each other. The shuffle feed sorting members 26 are fixed between and bolted to parallel first frame members 31 supported by the four first links 13. The sorting members 27 are fixed between the second side frame members 32 supported by the four parallel second links 14.

The sets of shuffle feed sorting members are driven or oscillated in opposite directions by suitable means including a shaft 34 carrying two pairs of eccentrics 35 and 36 to which the drive links 37 and 38 are attached and extend to the frame members 32 and 31 respectively. The eccentrics are rotated with the shaft 34 which is driven through a chain drive 40 extending from a transmission 41 and a drive motor 42. By energization of the drive motor, the sorting member beds are caused to oscillate back and forth by the eccentric drives such that alternate sorting members move together but adjacent sorting members move 180 degrees out of phase to cause an oscillatory motion thereby advancing articles fed onto the bed in rows and aligning elongated articles as they are fed in the mainstream. The shuffle feed structure just described and on which the subject invention is based generally is shown and described in U.S. Pat. No. 2,792,929, Shuffle Feed Structure, issued on May 21, 1957. The disclosure of that patent is incorporated by reference into this description.

Figure 4B:
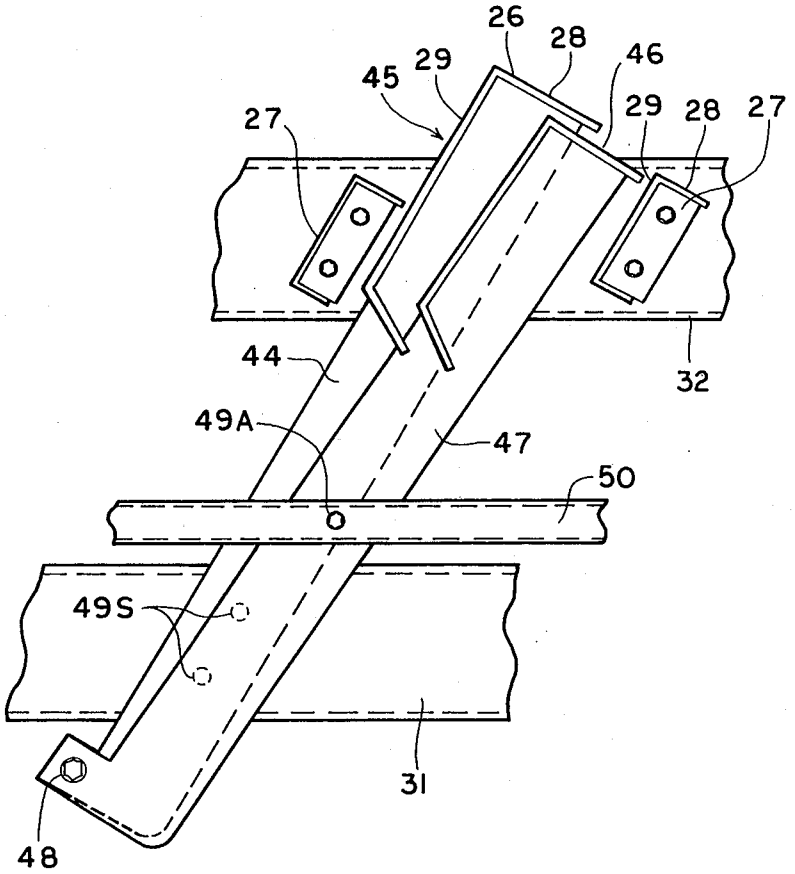
FIGS. 4A and 4B are enlarged views of an adjustable flight member employed in the subject invention.
Figure 4A:
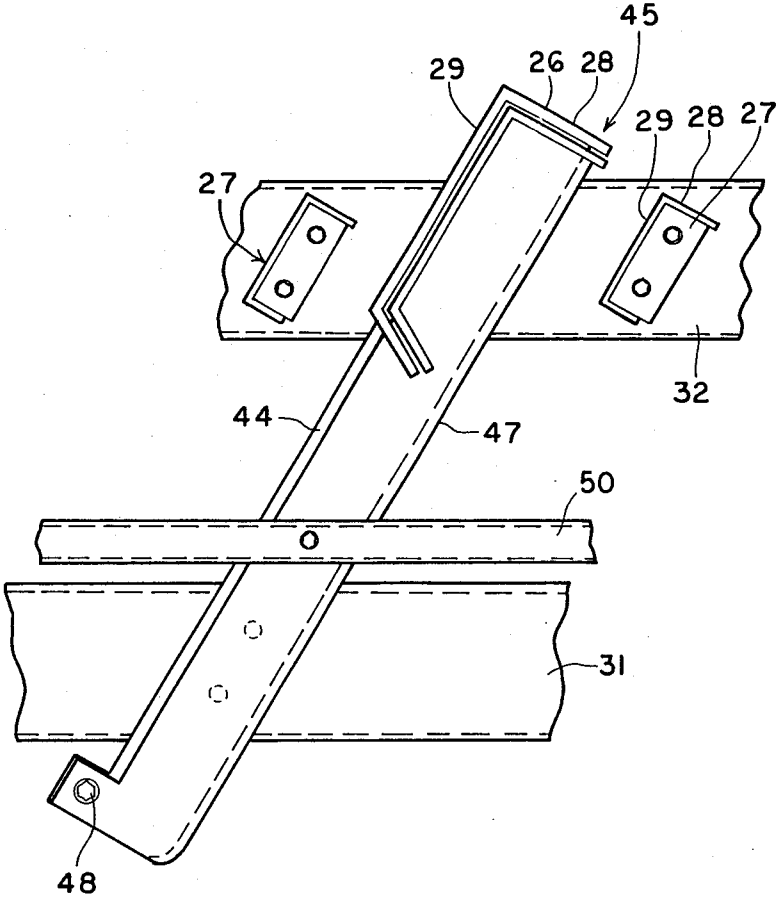

In accordance with the present invention, means are provided for sorting by size articles advanced across the feeder by allowing spaces between the shuffle members, which spaces are easily adjustable in size. Accordingly, as shown in FIG. 4A the shuffle members 26 and 27 are spaced apart such that articles can pass therebetween and be separated from the mainstream of articles advancing across the feeder. However, each shuffle member 26 includes relatively movable parts which serve to vary the thickness of each shuffle member thereby changing the spacing between adjacent flights. In this manner the sorting size can be altered.

Figure 6:
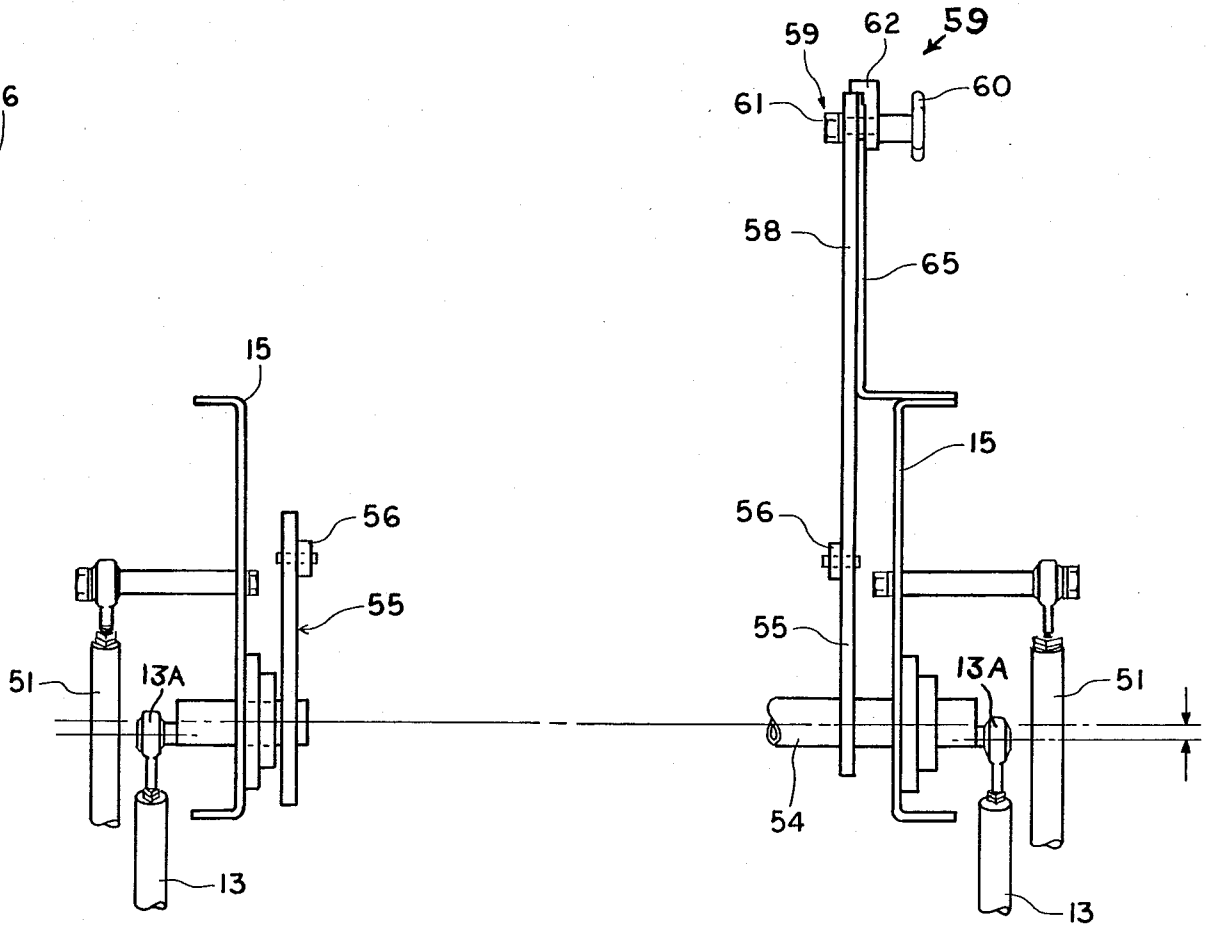
FIG. 6 shows the apparatus of FIG. 2 along the line 6—6.
Figure 5:
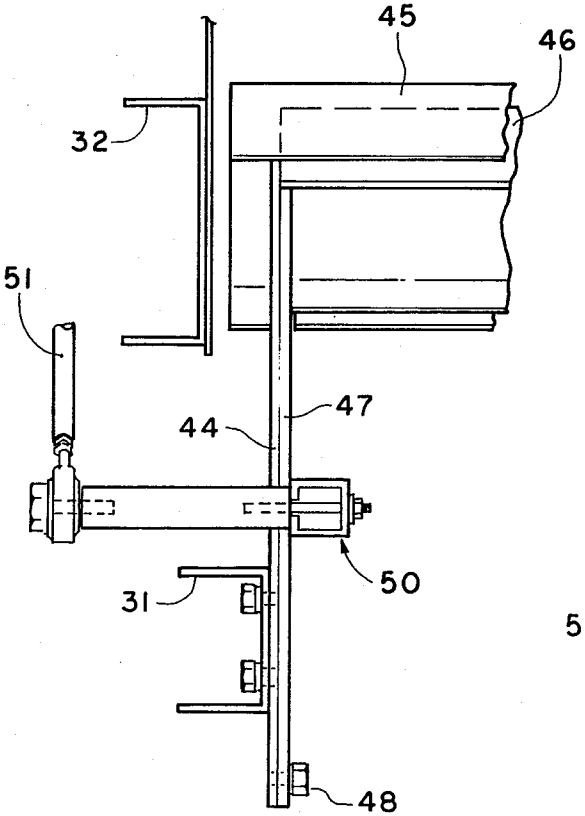
FIG. 5 is a view along the line 5—5 of FIG. 2.

Accordingly, the shuffle member 26 comprises an outer shell or part 45 forming the front face 28 and the top face 29 supported on an arm 44. Fitting within this outer shell is an inner shell or part 46 which is fixed to a lever 47 extending down to a pivot pin 48 as shown in FIGS. 4 through 6. Pins 49S attach the arm 44 of the shuffle member to the first frame member 31 while pins 49A attach the inner part 47 to a rail 50. This rail is supported on rods 51. The lever 55 includes an extension 58 connecting with a clamping means 59.

The clamping means 59 (shown in FIG. 6) comprises a handle 60 threaded onto a bolt 61 for forcing a clamp 62 against an indicator plate 65. Thus, by loosening the clamp 59 the lever 58 can be swung or rotated left or right in the direction of the arrows 66 (FIG. 2) so as rotate shafts 54 that have the upper ends of links 13 attached to the eccentric pivot 13A. The motion of the eccentric changes the position of second frame member 32 relative to the first frame member 31. This changes the spacing between members 27 and outer shell 45. As the frame member 31 moves closer to the frame member 32, the rod 51 moves the rail 50 carrying the inner shell 46 away from the outer shell 45. The linkage is such that shell 46 moves twice as much as the outer shell 45, thereby keeping the gap between members 27 and 45 equal to the gap between shell 46 and the member 27 next to it. When the frame member 31 moves farther from the frame member 32 the opposite motions take place to maintain equal gaps between adjacent parts. In this manner, the position of each of the rails 50 relative to the frame members 31 is changed thereby to pivot the part 46 relative to the part 45 of the shuffle member and change the shuffle member thickness depending upon the positioning of the clamping means relative to the indicator plate. These altered positions are shown in FIGS. 4A and 4B.

Thus, it can be seen that the spacing between adjacent flight members can be altered by changing the positioning of the clamp 60 such that the size of articles sorted from the mainstream can be varied.

What is claimed is:

1. A shuffle feed sorting apparatus comprising:

a frame, a first set of transversely disposed inclined shuffle members carried by said frame, a second set of transversely disposed inclined shuffle members interposed between the shuffle members of said first set in alternating relation therewith, means mounting said sets of shuffle members for relative reciprocation in substantially parallel relation to each other to provide a valley-to-valley progression of a mainstream of articles supported on said shuffle members, means spacing at least a portion of said adjacent shuffle members apart to provide openings through which articles smaller than said openings can pass and be separated from the article mainstream for sorting said articles, at least a portion of one of said sets of said shuffle members being comprised of two relatively movable interfitting parts to allow a change of thickness of each shuffle member of said set portion, and means interconnecting each of one of said two movable interfitting pats to allow a change in thickness of each said shuffle member of said set portion in unison thereby to allow adjustment of the size of said openings.

2. A shuffle feed apparatus for sorting articles comprising:

a main frame;

a first set of transversely disposed inclined shuffle members;

a second set of transversely disposed inclined shuffle members interposed between the shuffle members of said first set in alternating relation therewith;

first and second side frame members to which said first and second sets of shuffle members are attached respectively;

first and second link members extending from said main frame to said first and second side frame members, respectively, to support said first and second sets of shuffle members for motion relatively parallel to each other;

means to drive said side frame members to reciprocate the first and second sets of shuffle members alternately and cause a valley-to-valley progression of articles supported on said shuffle members;

at least a portion of one of said sets of shuffle members being comprised of first and second relatively movable parts to cause a change of thickness of each shuffle member of said set portion and thereby change the spacing between the adjacent shuffle members;

a rail interconnecting each said first movable part to cause movement of said first movable parts of said set portion of shuffle members in unison and thereby change the thickness of said portion of said one set of shuffle members in unison;

rods connecting said rail to said main frame to cause said rail to move in unison with said one set of shuffle members; and means to change the length of said rods relative to said main frame to cause movement between said first and second relatively movable members and thereby change the spacing between the adjacent shuffle members to regulate a size of articles to pass between the adjacent shuffle members for separation from other articles.

3. A shuffle feed apparatus as defined in claim 2 wherein said length changing means includes:

eccentric members rotatably fixed to said main frame;

means fixing said rods to said eccentric members; and means for rotating said eccentric members to change the length of said rods.

* * * * *